United States Patent [19]

Marion

[11] Patent Number: 5,044,499

[45] Date of Patent: Sep. 3, 1991

[54] MACHINE AND METHOD FOR PACKAGING FOLDED SWABS

[76] Inventor: Louis Marion, 42230 Saint Victor Sur Loire, Vieux Bourg de Condamine, France

[21] Appl. No.: 443,702

[22] Filed: Nov. 29, 1989

[30] Foreign Application Priority Data

Dec. 1, 1988 [FR] France ..... 88 16490

[51] Int. Cl.[5] ..... B65B 9/02; B65B 35/30; B65B 41/16

[52] U.S. Cl. ..... 206/438; 206/484; 271/151; 271/216; 53/51; 53/375.4; 53/389.3; 53/389.4; 53/443; 53/450; 53/540; 53/553

[58] Field of Search ..... 206/438, 440, 441, 526, 206/555, 484, 494; 383/37; 271/151, 216; 53/64, 371, 389, 412, 430, 429, 443, 447, 450, 452, 480, 531, 540, 548, 550, 553, 51, 375.4, 389.3, 389.4; 414/791.5

[56] References Cited

U.S. PATENT DOCUMENTS

| | | | |
|---|---|---|---|
| 2,162,230 | 6/1939 | Salfisberg | 53/86 X |
| 2,541,387 | 2/1951 | Salfisberg | 53/429 |
| 2,606,412 | 8/1952 | Salfisberg | 53/451 |
| 3,002,324 | 10/1961 | Deaconson et al. | 53/443 X |
| 3,668,821 | 6/1972 | Benson et al. | 53/389 X |
| 4,003,184 | 1/1977 | Shiu | 53/32 |
| 4,085,560 | 4/1978 | McClosky | 53/27 |
| 4,597,243 | 7/1986 | Honegger | 53/430 |
| 4,606,173 | 8/1986 | Meier | 53/430 |
| 4,711,066 | 12/1987 | Fox et al. | 53/447 X |
| 4,858,416 | 8/1989 | Monaghan | 53/389 X |

FOREIGN PATENT DOCUMENTS

| | | | |
|---|---|---|---|
| 0266489 | 5/1988 | European Pat. Off. . | |
| 0056353 | 7/1982 | France . | |
| 34662 | 1/1965 | German Democratic Rep. | 271/216 |

*Primary Examiner*—Robert L. Spruill
*Assistant Examiner*—Linda B. Johnson
*Attorney, Agent, or Firm*—Eckert Seamans Cherin & Mellott

[57] ABSTRACT

This process is outstanding in that paper in the form of a roll (B) double the width of the bag (S) to be obtained is used, the unrolled strip is separated into two equal widths (B1) (B2), the two half-widths of paper are independently fed to the point where the folded swabs are brought, the stacked swabs are fed between the two half-widths of paper and brought into superimposition, then the two superimposed half-widths of paper are cold sealed and the bags obtained are transversally cut, continuously and automatically.

10 Claims, 3 Drawing Sheets

MACHINE AND METHOD FOR PACKAGING FOLDED SWABS

The invention relates to a bagging process and means for several swabs and the bag obtained.

The object of the invention relates to the technical sectors of handling materials in strips and their packaging.

Machines continuously and automatically producing folded swabs from spools are known, this is particularly the case with the machine covered by the French patent No. 81.00687 whose applicant is also the Holder.

These folded swabs must then be packed into boxes or bags. The bagging is generally implemented by hot sealing using suitable tools (wheels, rolls, etc) which is somewhat slow (pressure, temperature, etc). On the other hand, the swabs transferred from the folding station, are stacked on top of one another with a view to bagging, therefore, this represents quite a thickness which hinders the closure of the bag obtained by bringing together and sealing the two sheets of paper between which the swabs are stacked.

In order to avoid these disadvantages and provide quick and sealed packaging of the folded swabs with the minimum of bulk, this invention proposes the production of stacking swabs in shingle form and cold sealing sheets of bagging paper.

With this in mind and according to a first characteristic, paper in the form a roll, double the width of the bag to be obtained, is used. The unrolled strip is separated into two equal widths, the two strips are fed independently to the point where the folded swabs are brought, the stacked swabs are fed between the two strips of paper, then the two superimposed strips are cold sealed and the bags obtained are cross cut continuously and automatically.

According to another characteristic, the folded swabs are inserted between the two superimposed strips of paper by longitudinal offsetting in order to obtain stacks of swabs of reduced thickness.

Another characteristic is found in the means to produce bags which comprises of a main frame with at least one paper roll holder transversally positioned, at least one device to cut the unrolled strip(s) into two equal widths, deflector rolls and direction change bars for each half-width of strip, a pressure and drive cylinder for each pair of semi-widths of strip which is placed at the outlet of the folded swab feed device, the said cylinders providing the superimposition of the pair of half-widths of paper fed independently, wheels to cold seal the half-widths of paper to one another, into which the folded and stacked swabs are inserted and cross cutting tools for the bags thus obtained.

According to another characteristic, the folded swabs are inserted between the pairs of half-widths of paper by longitudinal offsetting obtained by pressure and drive cylinders of the pairs of half-widths of paper which are mounted so as to oscillate in such a way that by bringing the top drive cylinder closer to the bottom cylinder by one half-width of paper, the end of a swab is gripped and engaged between the two superimposed half-widths of paper, then by applying the swab against the bottom cylinder, lowering the swab onto the bottom cylinder and separating the top cylinder, the next swab can be gripped by bringing the top cylinder closer with offsetting with respect to the previous one thanks to the continuous feed of the cylinders driving the two half-widths of paper and the swab engaged.

These characteristics and others will be made apparent from the rest of the description.

In order to clarify the object of the invention however, without limiting it, it is illustrated by the accompanying drawings.

Figure 1:
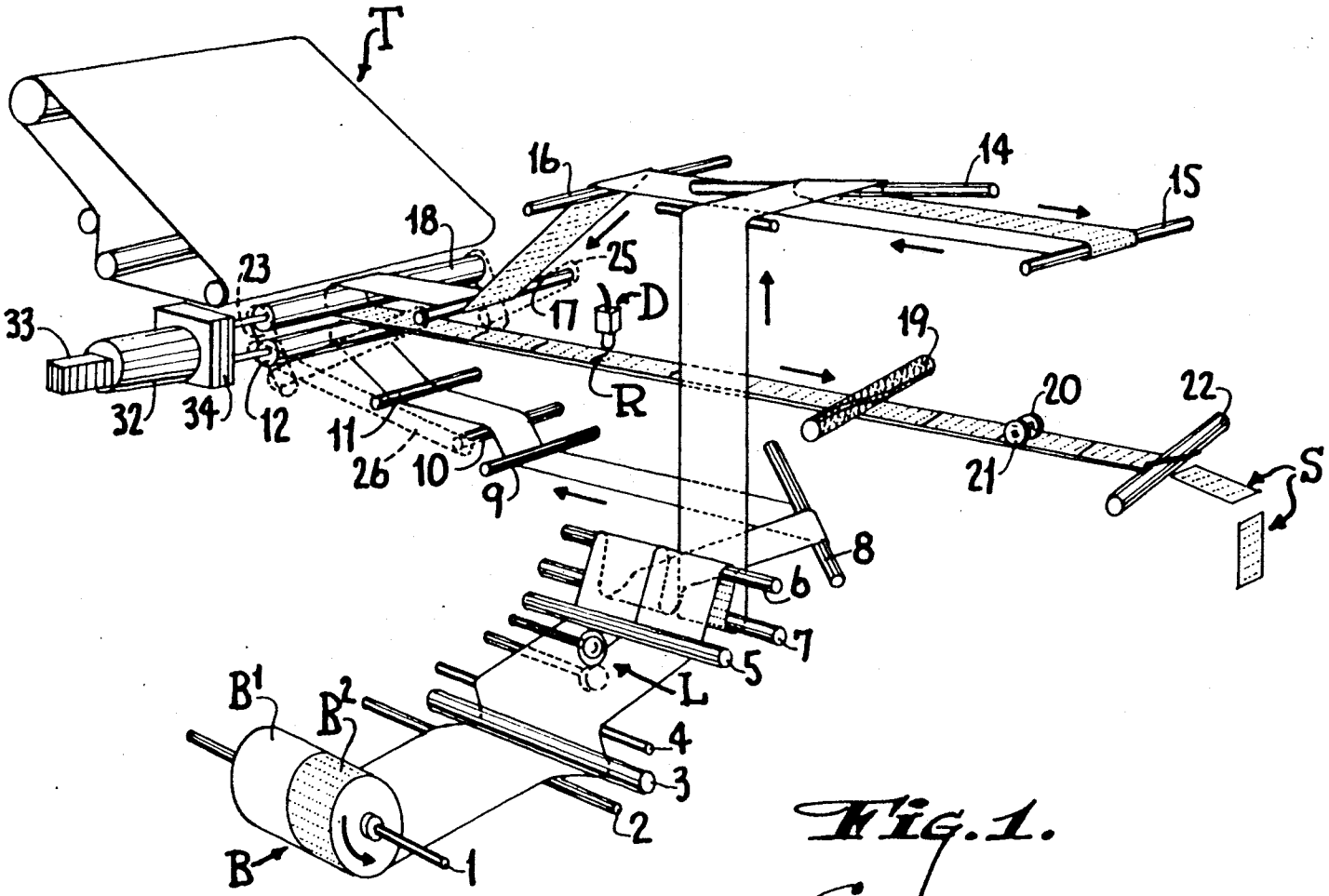
FIG. 1 is a very schematic perspective view illustrating the bagging process.
Figure 2:
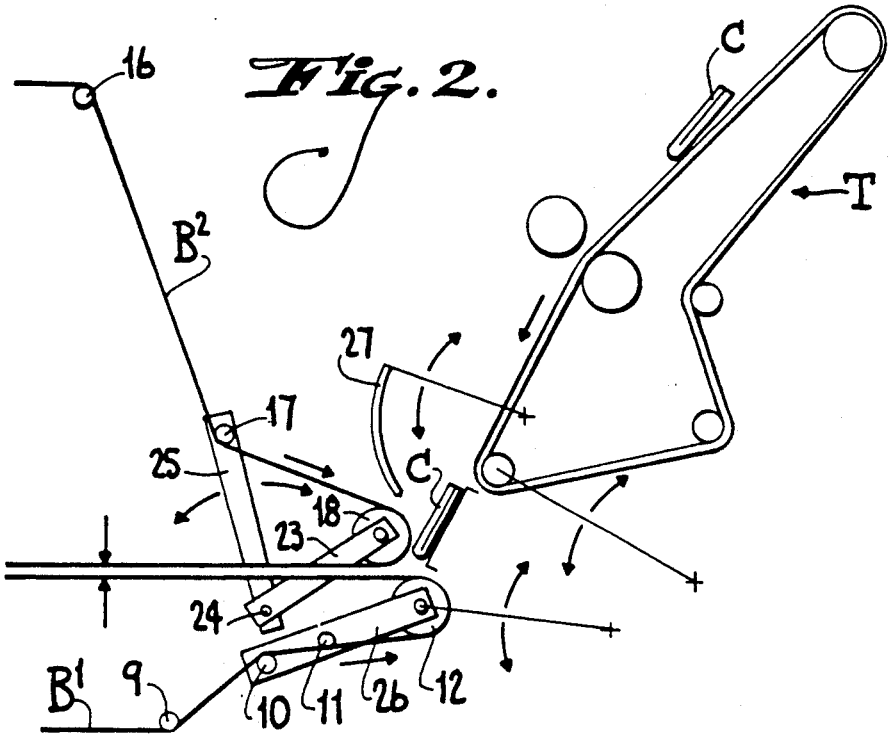
FIG. 2 is a schematic front view illustrating the insertion of the swabs between the strips of paper.

The object of the invention will become more apparent from the following non limitating description illustrated in the figures of the drawings.

The bagging plant according to the invention is adapted to the end of a machine to distribute rolled up strips cut to length then folded in order to make up swabs which are then guided between two grates on a multiple belt conveyor (T). The bagging plant comes into operation from this point. With this in mind, a suitable frame (not represented) supports the various components required for this operation. First of all, there is a bolt (1) transversally fixed to the outside of the frame. A roll (B) of paper comprising, for example, of a plain half-width (B1) of paper and a half-width (B2) of paper printed on the apparent side, is fixed onto this bolt.

The strip of paper unrolled with its completely plain apparent face, passes through groups of deflector and tension rolls (2), (3), (4) and (5), (6), (7) associated to the frame. Then, between these two groups of rolls, the strip is longitudinally cut into two equal half-widths corresponding to the plain and printed part, by a pressure cutting device (L) for example, using a disk with a cutting edge on a hardened cylinder. At the same time, a cutting operation (B3) is started in order to facilitate the subsequent opening of the bag, this cutting being finished when the bags are cross cut.

At the outlet of the roll (7), the plain half-width (B1) of paper is directed at the bottom part straight towards a bar (8) hinge mounted on the frame and extending according to a 45° angle with respect to the arrival direction of the said half-width of paper, in order for it to run according to a longitudinal direction to the frame. After running to another group of deflector rolls (9), (10), (11), the half-width (B1) of paper is spooled a onto bottom cylinder (12) transversally positioned at the end of the conveyor (T) and runs horizontally in the opposite direction towards the free end of the frame.

The other printed half-width (B2) of paper, at the outlet of the roll (7) is vertically directed to the top part of the frame, spooled onto a deflector roll (13) in order to horizontally join up with a second direction change bar (14) identical to the bar (8) but tilted at 45° in the opposite way in order to direct the half-width (B2) of paper towards the free end of the frame where it is spooled onto a return roll (15) in order to come back to the rear of the frame through deflector rolls (16), (17), bringing the semi-width of paper to a top cylinder arranged at the end of the conveyor (T) and in front of the bottom cylinder (12). The half-width (B2) of paper spooled onto the said cylinder (18) then horizontally runs towards the free end of the frame by being superimposed on the half-width (B1) of paper and leaving a space (e) between them for the swabs to be inserted.

It is to be noted that the printed side of the half-width (B2) of paper is then situated on the top taking the different orientations into consideration.

The half-widths (B1), (B2), of paper are continuously driven by the cylinders (12) (18) which are connected in a known manner to the drive components including a drive motor 32, speed variation, differential clutch 34 and other devices required for the bagging process. Similarly, after the half-widths (B1) (B2) of paper have been spooled onto the cylinders (12) (18), they are continuously driven by the tools to cold seal the two half-widths of paper which are mounted so as to rotate on the frame, i.e.: a knurled cylinder (19) to provide the cross seal between the packets of swabs and side wheels (20) (21) to longitudinally seal the edges. The bags (S) thus formed, are separated in a conventional manner, by a cross cutting tool (22) finishing the cut (B3) and fed towards any packing means.

It is to be noted that the paper used is of the pre-pasted type and according to which, when the bag is opened, the paste is only found on one side to prevent the bag from being re-used. This type of bag is commonly known as a peelable bag.

The two half-widths (B1), (B2) of paper must be driven under constant tension. With this in mind, the tilted bars (8), (14), are mounted in a special way.

The top cylinder (18) is mounted on side bars (23) hinged on a pin (24) supporting, via bars (25), the tension roll (17) applied against the half-width (B2) of paper. The bottom cylinder (12) is also supported by side arms (26) hinged on the roll (11) the other end of which supports the roll (10).

Figure 3:
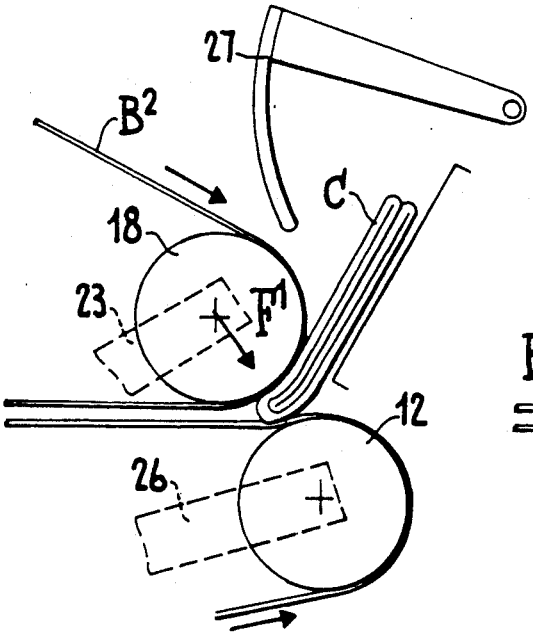
FIGS. 3 to 6 show very schematic partial views of the main phases of bagging swabs in shingle form.
Figure 4:
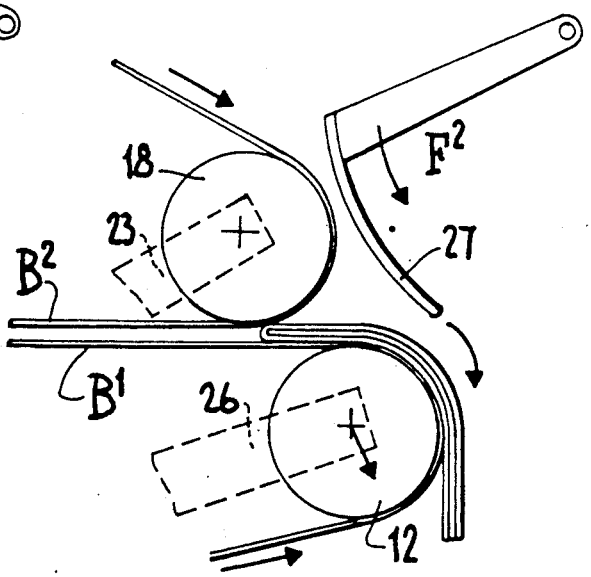

When the folded swabs (C) guided on the conveyor (T) abut against the bottom cylinder (12) in the top position, the top cylinder (18) which was previously separated, is then brought closer (arrow F1, FIG. 3) to the bottom cylinder in order to grip the front end of the swab, the two half-widths of paper continue to be fed and the swab is engaged between the two cylinders. At this point, a mobile flap (27) above the top cylinder (18) is swung towards to bottom (arrow F2, FIG. 4) to apply the swab onto the bottom cylinder (12) and thus clear the passage for the next swab by lifting up the flap.

Figure 5:
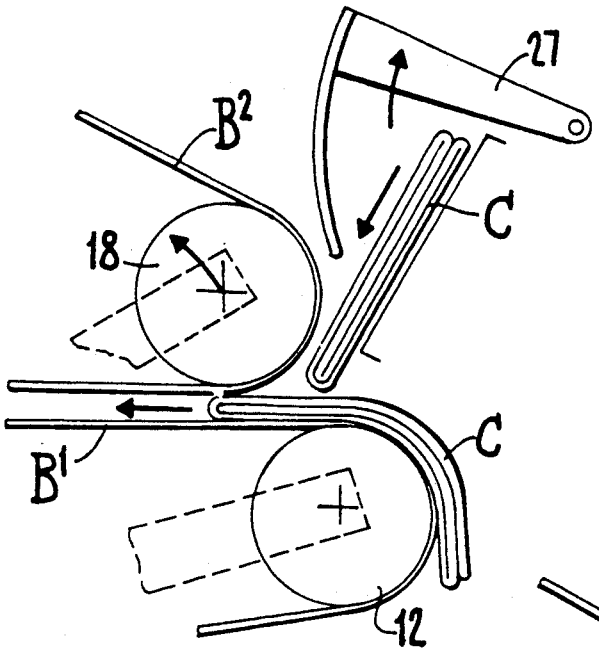
Figure 6:
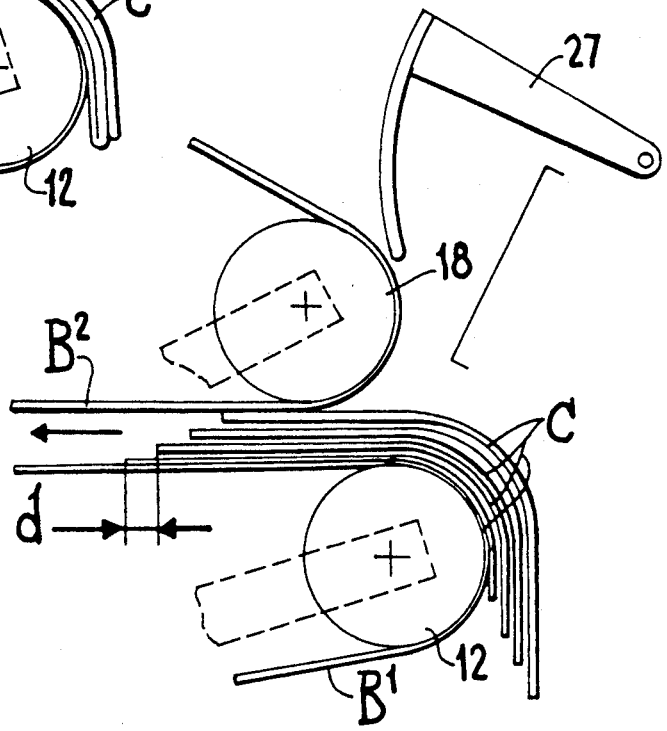
Figure 7:
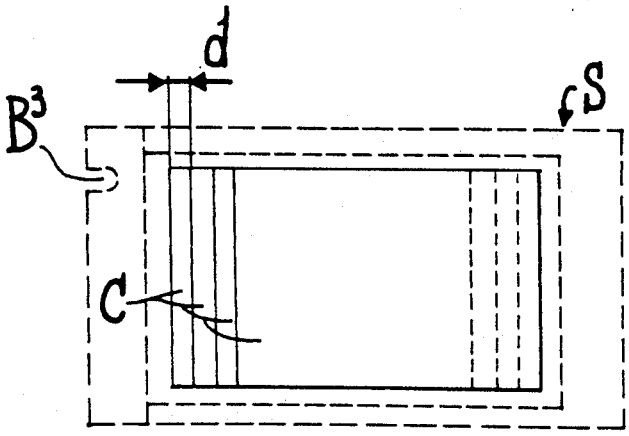
FIG. 7 is a top view showing the swabs in bags.

The bottom cylinder (12) is then lowered by the value of the thickness of the swab, whereas the top cylinder (18) is put back into the separated position (arrow F3, FIG. 5) enabling another swab to be abutted. Considering the continuous feed of the half-widths (B1), (B2), of paper, the following swabs are inserted between the said half-widths of paper with an offsetting operation (d). This so-called shingle arrangement of the superimposed swabs enables stacking with reduced thickness, assisted by the squashing of the swabs at the folds made by the folding station upstream. Therefore, the cold sealing is facilitated and the risk of points or non-sealed areas is avoided as with the case of the device of the prior art.

It is to be noted that the number of swabs bagged is freely determined and controlled by a preset counter.

The half-widths of paper are fed at a higher speed (by the differential device and clutch) between every packet of stacked swabs.

On the other hand, the positioning of the printing, pasted areas and the exact superimposition of the half-widths of paper are provided by detecting means (symbolized by the mark D), laterally arranged at the outlet of the cylinders (12), (18) and reacting in function of marks R on the paper.

The advantages are made clearly apparent from the description, once again, the quickness of bagging, the reduced thickness of the bags and the possibility of using printed paper are to be highlighted.

I claim:

1. A bagging machine for packaging folded swabs in a continuous and automatic manner, comprising:
   - a single reel of paper which is twice as wide as a packet to be obtained;
   - means for separating the paper into two half-widths, said two half-widths having reference marks thereon;
   - means for independently advancing the two half-widths to a location for receiving a plurality of folded swabs from a distribution device;
   - means for stacking the plurality of folded swabs in a longitudinally offset manner between the two half-widths;
   - means for detecting the reference marks to bring the two half-widths in exact superposition;
   - means for cold sealing the two superposed half-widths at a periphery around the plurality of folded swabs to form the packet; and,
   - means for cutting transversely along a sealed surface of the two superposed half-widths.

2. The bagging machine according to claim 1, wherein the means for independently advancing the two half-widths comprises a press cylinder and a drive cylinder located at an outlet of the distribution device so as to receive the plurality of folded swabs therebetween, the press and drive cylinders being rotated, and each of the half-widths of paper being in contact with a partial periphery of one of the press and drive cylinders so as to be advanced thereby.

3. The bagging machine according to claim 2, wherein the press and drive cylinders are hingedly mounted such that the cylinders can oscillate with respect to each other as the swabs are engaged between the cylinders.

4. The bagging machine according to claim 3, further comprising a pair of direction change bars hingedly mounted in an auto-orientating manner, and wherein each of the half-widths is maintained with a constant tension by being looped around one of the direction change bars.

5. The bagging machine according to claim 2, wherein a first pair of side bars are hingedly mounted, the press cylinder is mounted between the first pair of side bars at one of their ends, and an idler bar is mounted between the first pair of side bars at the other of their ends, a second pair of side bars are hingedly mounted, the drive cylinder is mounted between the second pair of side bars at one of their ends, a third pair of side bars is attached to the second pair of side bars at the other of their ends, and a roller bar is attached to an end of the third pair of side bars.

6. The bagging machine according to claim 2, further comprising a drive motor, a speed variation device and a differential clutch for driving the half-widths of paper at a greater speed between each stack of folded swabs.

7. The bagging machine according to claim 2, wherein the swabs engaged between the press and drive cylinders are forced against the press cylinder by a retractable mobile flap.

8. Bagging machine according to claim 2, wherein the half-widths (B1) (B2) of paper are exactly superimposed at their outlet of the cylinders (12) (18) via said detecting means reacting to the reference marks on the paper.

9. A method of continuously packaging folded swabs in packets, comprising successively performing the steps of:

advancing a substantially continuous sheet of paper which is twice as wide as the packets to be obtained;

cutting the sheet of paper into two half-widths;

separating the two half-widths to form a top half-width and a bottom half-width, said two half-widths having reference marks thereon;

stacking a plurality of folded swabs on the bottom half-width such that each successive folded swab is longitudinally offset from a preceding folded swab by a portion of a folded swab length;

detecting said reference marks;

superposing the top half-width onto the bottom half-width in exact superposition as a function of detecting said reference marks;

cold sealing the two superposed half-widths at a periphery around the plurality of folded swabs;

cutting the two superposed half-widths transversely along a cold sealing surface to form one of the packets.

10. Bag of stacked swabs produced according to the process of claim 9, wherein there is reduced thickness and maximum sealing.

* * * * *